US005149047A

United States Patent [19]

Tucker

[11] Patent Number: 5,149,047

[45] Date of Patent: Sep. 22, 1992

[54] FOLDABLE ADD-ON EASEL WITH SPRING PAGE HOLDERS FOR BOOKCOVERS/FOLDERS, WITH LINE GUIDE ATTACHMENT

[76] Inventor: Annabelle D. Tucker, 4480 Sherman Oaks Cir., Sherman Oaks, Calif. 91403

[21] Appl. No.: 754,045

[22] Filed: Sep. 3, 1991

[51] Int. Cl.[5] ..... A47B 97/04

[52] U.S. Cl. ..... 248/459; 248/174; 248/460

[58] Field of Search ..... 248/460, 472, 459, 455, 248/174; 206/45.25, 45.24; 40/155

[56] References Cited

U.S. PATENT DOCUMENTS

| | | | |
|---|---|---|---|
| 3,410,516 | 11/1968 | Criswell | 248/459 |
| 4,886,231 | 12/1989 | Doerksen | 248/460 X |
| 4,991,812 | 2/1991 | MacEwan | 248/459 |
| 5,029,798 | 7/1991 | Clark | 206/45.25 X |

FOREIGN PATENT DOCUMENTS

| | | | |
|---|---|---|---|
| 0442255 | 2/1936 | United Kingdom | 248/460 |

*Primary Examiner*—Ramon O. Ramirez

[57] ABSTRACT

A foldable easel structure for attachment to the cover of a book that folds with the book, keeping the easel readily available when needed. The attached spring page holders are coated to slide on the page when the book is closing, maintain place in the book and allow easy turning of pages by the disabled or young person. The adhesive back of the easel structure also provides the means of attachment to student or business folders and copy boards to allow display of material in an inclined position or for purposes of comfort in copying the material or inputting a computer. A telescopic line guide for the copy page is supported by insertion of the exposed end of the spring page holder into the open lower end of the guide line stem. The guide line bar may be a magnifying means.

6 Claims, 3 Drawing Sheets

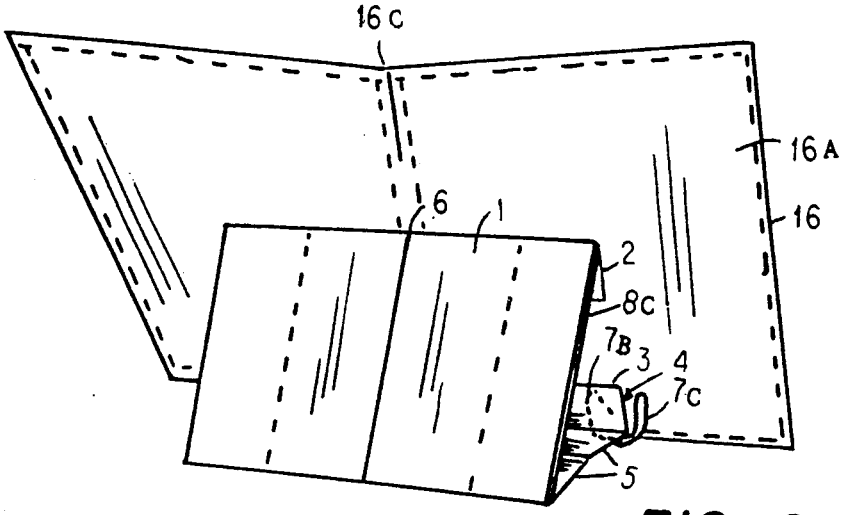
FIG. 6
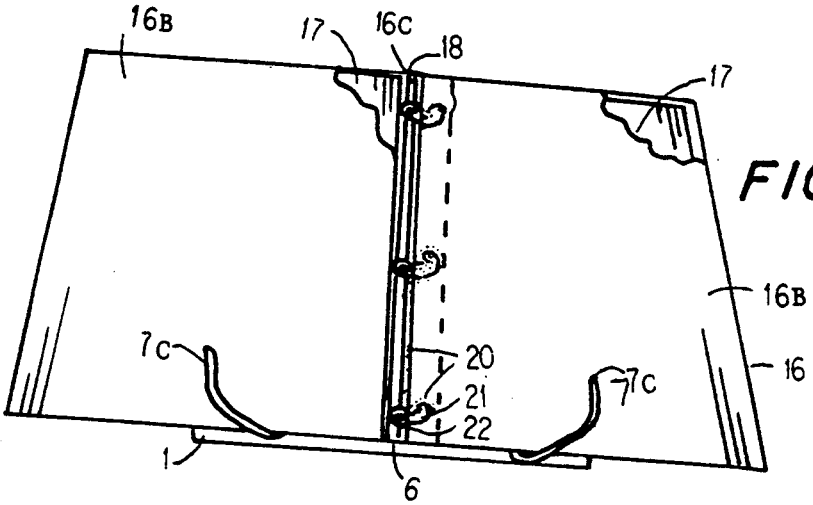
FIG. 7
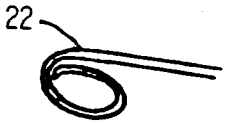
FIG. 9
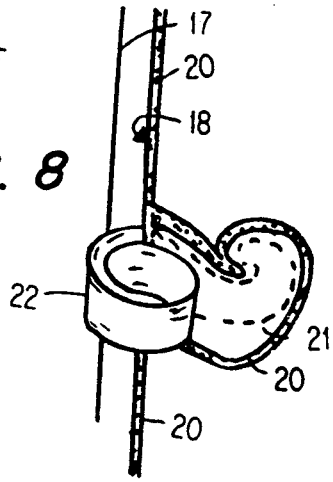
FIG. 8
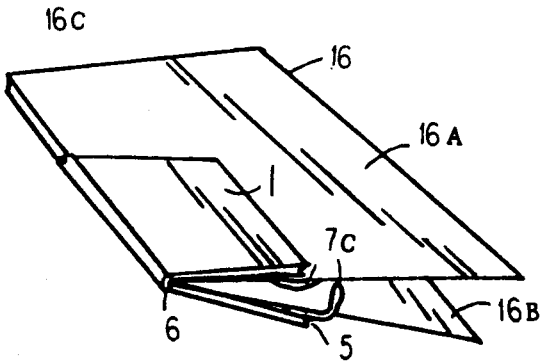

FOLDABLE ADD-ON EASEL WITH SPRING PAGE HOLDERS FOR BOOKCOVERS/FOLDERS, WITH LINE GUIDE ATTACHMENT

BACKGROUND OF THE INVENTION

This invention relates generally to a foldable, stick-on easel and spring page holding structure to economically convert school book covers or foldable copy holders into transportable, easy-to-use reading or display stands. Also of concern in this invention is the foldable, assembled stand for books or flat copy that can convert to a ring binder by providing lock-in, removable rings for displaying perforated pages in notebook form. With rings removed the folder is used to support a large book or display art flat against the inclined back while base rests in the spring page holders. A line guide fits onto the assembly to assist reading copy.

Conventional easels, to support open books , copy or display art are usually constructed of wood or metal resulting in a relatively expensive product. That separate support for books or the like can be awkward to transport and is easily misplaced. It is usually not available at time and place of need, such as the classroom. Some easels, undesirably, require adhesion to the inside cover of the book to function. To securely hold a book in open position, the spine of the book should be spanned with a supporting means, that folds with the book. Pages of a book need to be held open, in use, and easily turned by a disabled or young person. The page holder should allow pages to slide in their grip to prevent damage to the pages if the book is closed with the page holder in place. The support base of the easel should allow easy extension yet be able to close automatically around the spine of the book or folder to avoid damaging the assemblage and for ease of handling by the younger student or the disabled person.

A principle feature of the present invention is the provision of an improved, easy to use, attachable, foldable easel and spring page holding structure as an accessory for converting bookcovers, folders and the like into an inclining support stand for books or display art. The display art may be perforated or unperforated and the means to support both is provided by making the ring page holders removable from the centrally adhered ring pocket strip.

SUMMARY OF THE INVENTION

In accordance with the present invention there is provided a precreased sheet of foldable material to guide the formation of the easel structure. A fold up support base is provided. P. S. adhesive extension flaps at the top back support and the bottom horizontal end of the sheet are creased to fold inwardly to form the points of attachment to a bookcover, or the like, after the firm back supports and spring page clips are adhered in place.

A further feature of the invention is the provision of firm supports that are separately adhered to the vertical outer edges of the inner face of the back support wall to leave a central support void that allows the easel structure to fold around the spine of a closing book.

Another feature of the invention is the provision of spring page holders that are positioned, and partially sealed, within the adhesive flap of the assembled easel structure. The spring page holders support the pages of a book in open position or the base of copy pages on an inclined support stand. The coating on the exposed portion of the spring page holder is slippery enough to allow a young or disabled person to turn the pages of a book easily or to employ a rubber tipped device to grip the page for turning and resecuring under the opposite spring holder.

An additional feature of this invention is the provision of peel-off to expose adhesive strips on the distal flaps of the creased sheet for easel structure that provide the attachment means to a book or the like.

Another feature of the invention is to provide a folding copy stand using the add-on easel structure of the present invention to support the inclined position of the stand as well as the lower edge of the pages to be copied.

An additional feature of the present invention is to provide a telescoping guide line whose hollow tubular lower, open ended, stem support fits onto, and is supported by, the vertical length of a coated spring page holder attached to the folding copy stand. The provided horizontal line guide is secured by a perforated slide structure whose perforation fits snugly but moveably onto the telescoping tubular vertical support body to allow guided scanning of the line copy page. The horizontal guide may be a magnifying bar.

A further feature of the present invention is the provision of an assembled folder using the add on easel structure of the present invention. The folder provides removable page rings to adapt its page holding ability to perforated or non-perforated page as well as to act as a support for large books or copy displays when the page rings are removed.

Further features and advantages of this invention will become more apparent from the following description, the appended claims thereto, and the drawings.

BRIEF DESCRIPTION OF THE DRAWINGS

The accompanying drawings illustrate the invention. In such drawings:

FIG. 6 is a perspective back view of the assembled add-on easel structure attached to the back cover of the foldable, removable ring, binder.

FIG. 7 is a perspective view of the interior of the foldable, removable ring, binder with interior walls cut-away to show interior detail and removable page rings.

FIG. 8 is a perspective view of the removable page ring seated in its locking slot and a separate top view of a removed page ring.

FIG. 9 is a perspective view of the closed foldable binder with the add-on assembled easel attached and spanning the spine of the closed foldable binder.

DETAILED DESCRIPTION OF THE PREFERRED EMBODIMENTS

Figure 1:
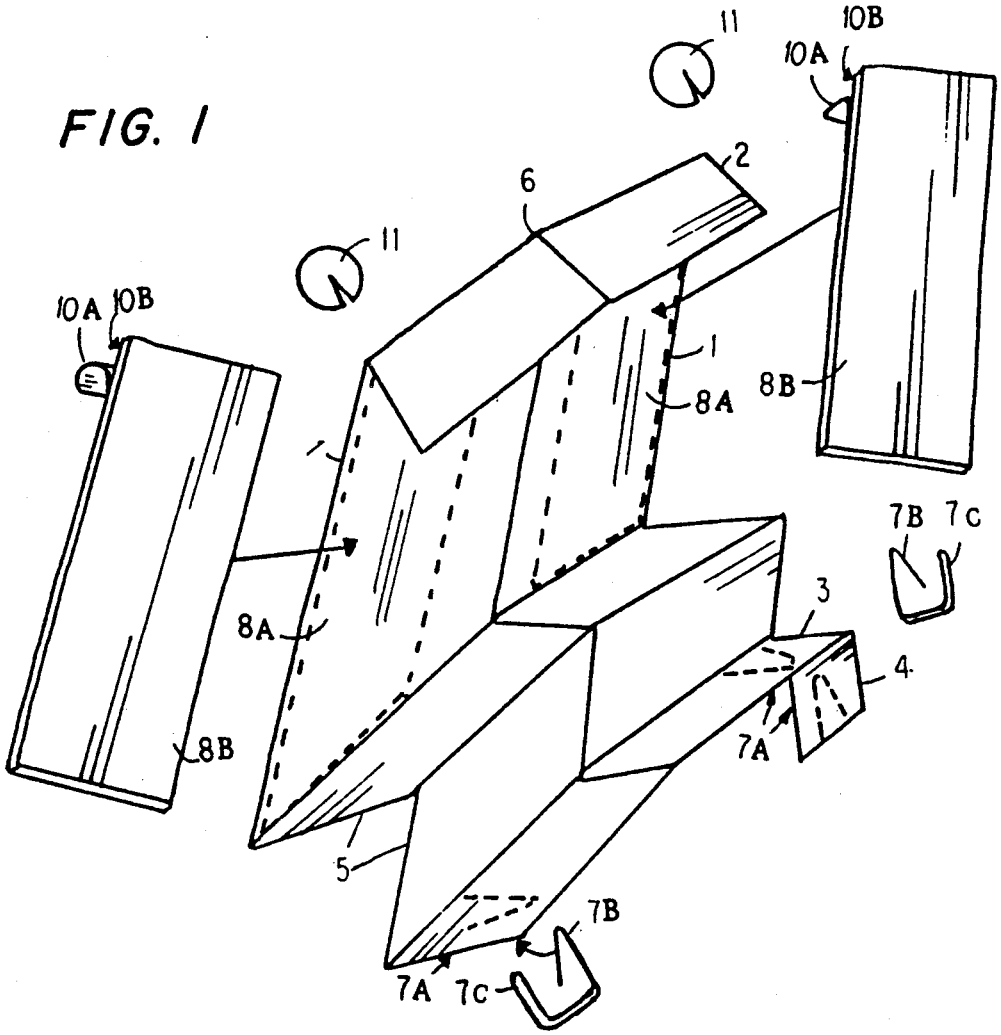
FIG. 1 is a perspective, exploded plan view of the add on easel assembly.

Referring now to FIG. 1 there is shown a pre-creased sheet of foldable material for easel 1 with an exploded view of the essential parts of the invention to form the add-on easel 1 structure. The central crease 6 allows folding the closed easel 1 around the spine of a closed book. The easel supports 8B, for the inner back of the easel 1 are made of a stiff material such as cardboard. The supports 8B are spaced apart at the outer, interior, vertical edges of the easel 1 back surface 8A leaving a central void to allow for vertical folds 6. The supports 8B may have a covered 10A adhesive surface 10 B for packaging the easel parts, unassembled. A horizontal crease at the top end of the back support area 8A, of the easel 1 sheet material, folds inward to provide a top attachment surface 2.

Figure 2:
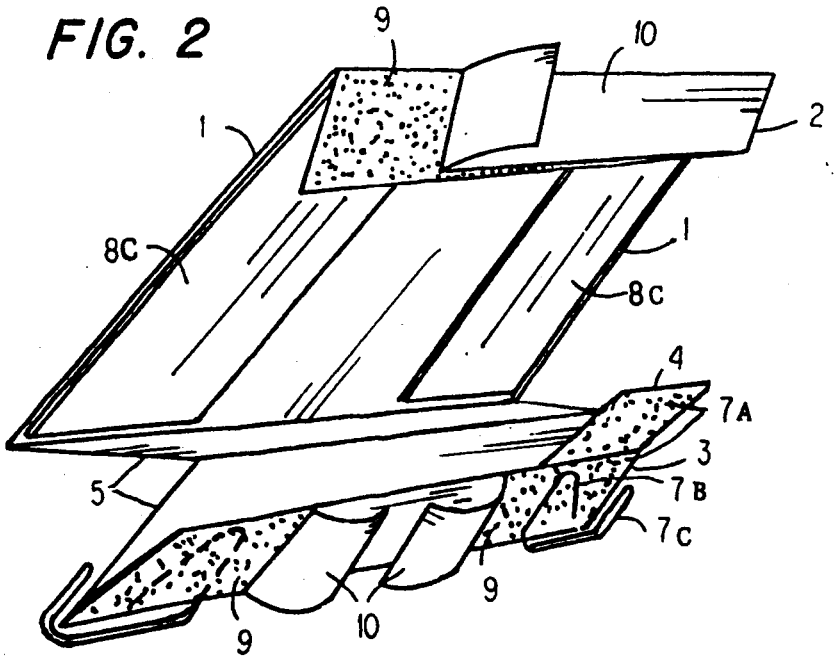
FIG. 2 is a perspective front view of the assembled add on easel with adhesive surfaces partially exposed.

At the base of the back structure 8A, the horizontal creases fan fold to form the support base 5 for the easel structure 1 as shown in FIG. 1 and FIG. 2. The lower attachment flap 3 is folded up and out from the lower front edge of the fan-folded support base 5 of the easel material 1. In FIG. 2 the two extended small flaps 4 are folded out and down from top horizontal crease of the attachment flap 3. The small flaps 4 fold down to secure the uncoated ends 7B of the spring page holders 7C within the adhesive surface 7A on the lower attachment flap 3 and the inner surface of the small flap 4. After securing the spring page holders 7C in a sealed manner, the outer surface of the small flap 4 become a continuation of the lower attachment surface 3. The outer surfaces of flaps 2, 3 and 4 are adhesive (PS) coated 9 and covered with a protective sheet 10 to allow packaging as an add-on separate easel, if desired. FIG. 2 shows the easel 1 supports 8B adhered to the inner back 8 AC of the assembled easel 1 structure. The spring page holders 7C are shown secured in place 7A. When the protective cover 10 on the adhesive surface 9 is removed, the easel 1 may be attached to the lower back fold of a bookcover 12, folder 16, support for a copy stand or the like, as seen in FIG. 3, FIG. 4 and FIG. 6.

Figure 3:
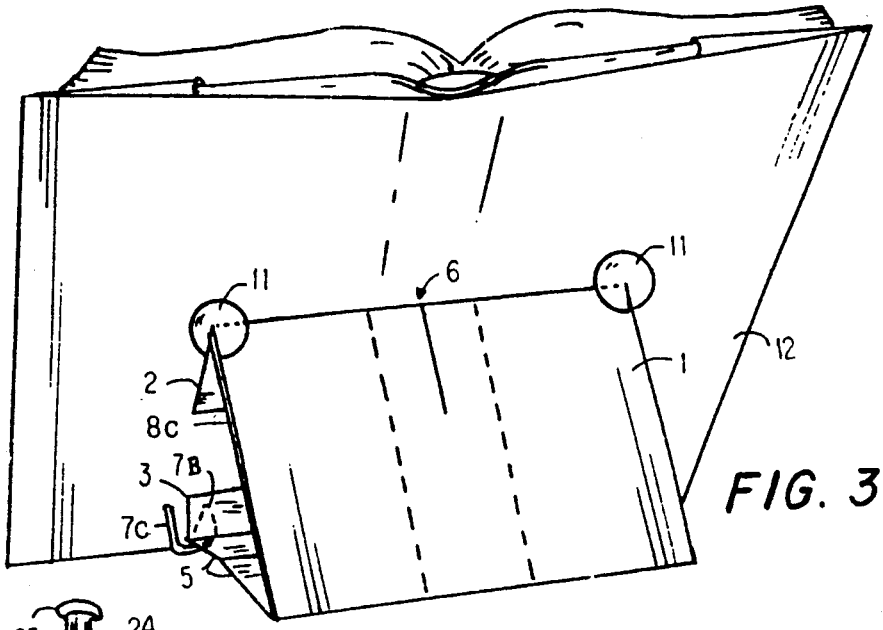
FIG. 3 is a perspective back view of the assembled add-on easel attached to the back cover for a book, shown in open position.

In FIG. 3 there is shown the add on easel 1 attached to the lower central back of a cover for books 12 as it appears on an open inclined book. The upper corners of the easel attachment 2 are reinforced with split adhesive dots 11. The spring page holders 7C are exposed and ready to be pulled down and forward into the inner surface of the open book to hold the pages in open position. The attachment flap 3 is aligned with the resting lower folded edge of the cover for the book. The fan folded base 5 of the easel 1 is extended into open position to support the inclined book.

Figure 4:
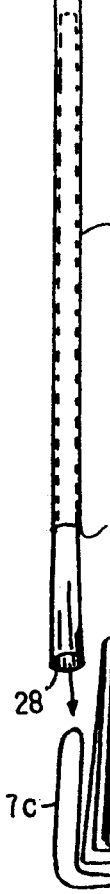
FIG. 4 is a perspective front view of the foldable copy stand with the add-on easel attached to its back lower surface for support.
Figure 4:
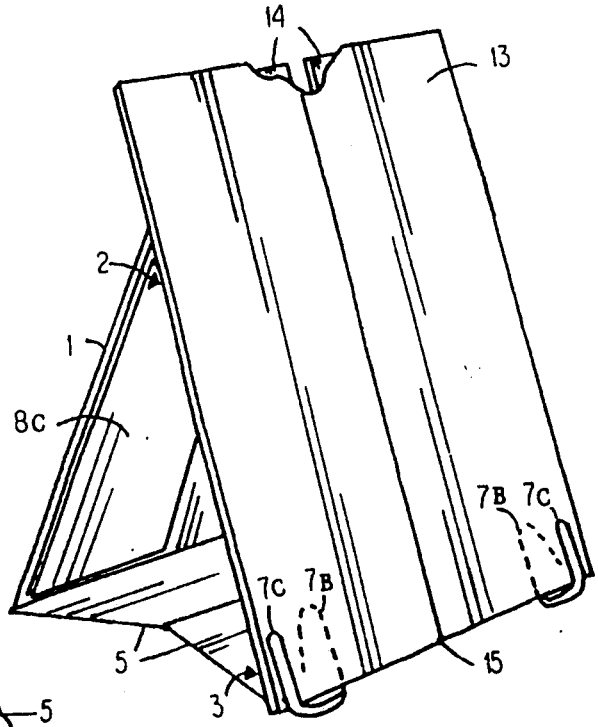
Figure 4:
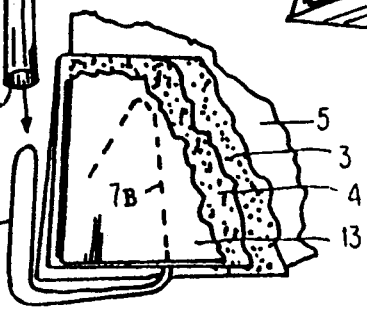

FIG. 4 shows the assembled easel 1 adhered to the lower back of a foldable support 13 to form a copy stand. The split supports 14 form the folding 15 back for the face sheet 13 of foldable material. The coated part of the spring page holders 7C are pulled into forward position to support the base of a copy page or a book.

Figure 5:
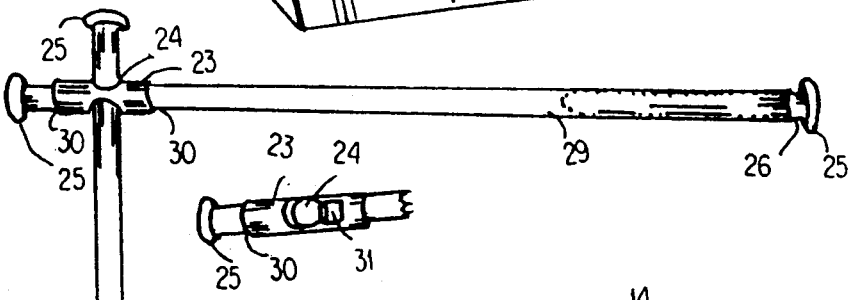
FIG. 5 is a perspective view of the tubular line guide structure poised to cap its hollow end securely onto the vertical end of a spring page holder at the base of a copy stand.

The line guide, with its telescoping stem 27 and linear arm 29 are shown in FIG. 5. The structure is supported by capping the open tubular base 28 of the telescoping stem 27 over the vertical part of the coated spring page holder 7C. The stem slide opening 24 of the slide structure 23, firmly, but slidably fits onto the stem body 27. One end of the linear guide bar 29 seats within an open end 30 of the slide structure 23. A grip tube formed by plug 25 seated in its open end 26 and the structure seated into the free open end of the slide structure 23. A like plug 25 is seated in the open ends 26 of the stem 27 and the linear guide arm (tube) 29. The linear guide arm may be a clear sheet of material or a means of letter magnification. A slide stop plate 30 is provided adjacent tapered aperture base of line guide slide 23.

The folding ring binder 16 is shown in FIG. 6 with the add-on easel 1 adhered by its adhesive flaps 2 and 3 to its central lower back 16A. The spring page holder 7C is shown in back of the folder cover 16A ready to be pulled down and to the inner front 16B to secure the base of copy or art pages. The fan-fold base 5 of the easel 1 is in open position to support the inclined folder. In FIG. 7 the open folder shows the removable rings 22 hooked into their pockets 21. The pockets 21 are formed by sealing a double thickness of the folder material as shown in FIG. 8. The removable rings 22 are shown made of a firmly flexible material to hold pages that are perforated with a rectangular punch means. The hooked extended securing end of the ring 22 is seated into the pocket 21 and pulled down to seat the hook against accidental pull-out.

The folder 16 with the easel 1 attached is shown in FIG. 9 in closed position. The easel 1 folds vertically 6 to span the closed spine 16C of the folder 16AB when the fan folded base 5 of the easel is previously collapsed upon itself. The folder backs 16AB are shown in cut away in FIG. 7 to expose the slip-in firm support 17. Openings 18 for the supports 17 are formed by sealing the edges 19 of the front 16B and back 16A covers around their peripheral edges 19. The outer cover 16 A has a fold line 16C and the inner cover 16B is split to allow insert of the supports 17 in openings 18. The spring page holders 7C are shown extending from their insert seal 7A of the easel 1 flaps 3 and 4 in FIG. 7 and FIG. 9.

In the foregoing descriptions, specific examples have been used to describe the invention. It is understood by those skilled in the art that certain modifications can be made to these examples without departing from the spirit and scope of the invention.

I claim:

1. A collapsible, portable, easel structure to be attached to the back of a book comprising, an elongated blank having therein a plurality of fold lines to define top, central and bottom panels; said top panels being adhesively coated and folding inwardly toward the central panel to extend toward the inward fold edge of said bottom panels, forming an attachment means for a book back; reinforcement means secured to the central panel so that a gap is formed between said support means permitting the central panel to fold around the spine of a book; said bottom panels comprising a plurality of foldable flaps forming a support base for the easel and said inward folded edge of the bottom panels being adhesively coated, forming attachment means for a book back and also for securing spring page holders.

2. The invention described in claim 1 wherein a line guide means is attached to the easel.

3. The invention described in claim 2 wherein the guide means comprises a tubular base, a stem telescopable to the tubular base and a guide bar attached to said stem.

4. The invention in claim 3 wherein the guide bar is made from transparent material.

5. The invention as described in claim 3 wherein the guide bar is a letter magnifying means.

6. The invention described in claim 3 wherein the guide bar is vertically adjustable with respect to the stem.

* * * * *